United States Patent [19]

Phelps

[11] Patent Number: 4,481,712

[45] Date of Patent: Nov. 13, 1984

[54] KNIFE FOR RELEASIBLE ATTACHMENT TO A BASE

[75] Inventor: Paul S. Phelps, Maryville, Tenn.

[73] Assignee: Star Sales Company, Inc., Knoxville, Tenn.

[21] Appl. No.: 476,920

[22] Filed: Mar. 21, 1983

[51] Int. Cl.[3] ..... B26B 3/06

[52] U.S. Cl. ..... 30/151; 30/156; 24/3 F; 24/163 K; 224/163

[58] Field of Search ..... 30/151, 156, 161, 163; 24/3 F, 163 K; 224/163

[56] References Cited

U.S. PATENT DOCUMENTS

| | | | |
|---|---|---|---|
| 652,245 | 6/1900 | Cameron | 24/3 F |
| 1,068,209 | 7/1913 | Bird | 24/3 H |
| 2,162,654 | 6/1939 | Vaisey | 30/155 |
| 4,096,979 | 6/1978 | Collins | 224/163 |
| 4,347,665 | 9/1982 | Glesser | 30/161 |
| 4,377,939 | 3/1983 | Reinsdorf | 24/163 K X |
| 4,389,775 | 6/1983 | Collins | 30/151 X |

FOREIGN PATENT DOCUMENTS

| | | | |
|---|---|---|---|
| 372192 | 8/1931 | United Kingdom | 30/151 |

*Primary Examiner*—E. R. Kazenske
*Assistant Examiner*—Willmon Fridie, Jr.
*Attorney, Agent, or Firm*—Pitts and Brittian

[57] ABSTRACT

A folding knife unit particularly for the attachment to wearing apparel. A base plate of the unit can be provided with elements for securing the base plate to the apparel, these elements usually being on the rear surface of the base plate. The front surface of the base or base plate is provided with a headed stud in one embodiment to engage a notch in one end of the folding knife, and a second stud to pass through an aperture in one side plate of the knife and an aligned aperture in the closest knife blade. The second stud is provided with an annular recess, and the action of the backspring causes the knife blade to releasibly engage that recess whereby the knife is releasibly secured to the base plate. In another embodiment, a spring clip engages one end of a side plate rather than the headed stud.

12 Claims, 5 Drawing Figures

KNIFE FOR RELEASIBLE ATTACHMENT TO A BASE

DESCRIPTION

Technical Field

This invention relates generally to folding or pocket knives, and more particularly to a folding knife unit which may be, for example, attached to wearing apparel such as a belt or similar accessory.

Background Art

Many persons find it desirable to have a small folding knife, commonly called a pocket knife, handy for their use. Men, for example, frequently carry a pocket knife in their trousers' pocket either loose or attached to the end of a chain. This knife must be moved to another pair of trousers whenever the individual changes his wearing apparel. For women, the knife is usually just carried loosely in their purse. As such, it frequently gravitates to the lower portion of the purse and sometimes is difficult to locate amid the other material carried therein. In either of these situations, it is sometimes found that the knife is not availabe whenever its use is desired.

Accordingly, it is one object of the present invention to provide a knife which is more readily available for use.

It is another object of the invention to provide a folding knife which may be releasibly attached to a rigid support base, the base being attachable to wearing apparel such as a belt.

It is a further object of the present invention to provide a folding knife which is securely held upon a base support but may be released therefrom with a minimum of manipulation.

Other objects and advantages of the invention will become apparent upon reading the detailed description and by reference to the drawings.

Disclosure of the Invention

In accordance with the invention a folding knife is releasibly attached to a rigid base plate. This base plate may then be attached to wearing apparel such as a belt, a purse strap or the like. The releasible attachment mechanism for the knife includes a stud projecting up from the base, which stud passes through an aperture in one side plate of the knife and frictionally engages the blade knife. A slight depression of the knife blade into its case brings about a disengagement of the stud with the blade and therefore permits the removal of the knife from the base plate.

Brief Description of the Drawings

FIG. 1 is a front view of the present invention shown as being attached to a belt or the like.

Best Mode For Carrying Out The Invention

Figure 1:
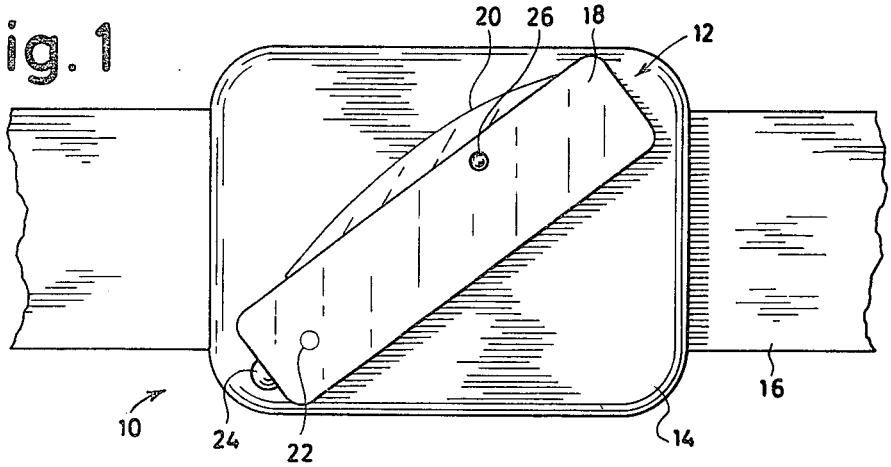

Referring to FIG. 1, the present invention is illustrated generally at 10. A folding knife 12 is releasibly attached to a base plate 14 which in turn is attached to wearing apparel such as a belt 16. The knife 12, of generally conventional construction, has a pair of side plates 18 (only one shown) and a blade 20. The blade 20 pivots about blade pivot 22 in a normal manner. The means for attachment of the knife 12 to the base plate 14, although described in more detail hereinafter, involves the use of a headed stud 24 and a cylindrical stud 26.

Figure 2:
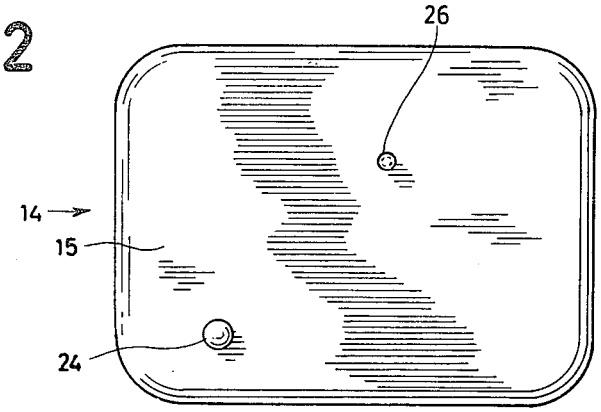
FIG. 2 is a front view of the base plate of the present invention.
Figure 3:
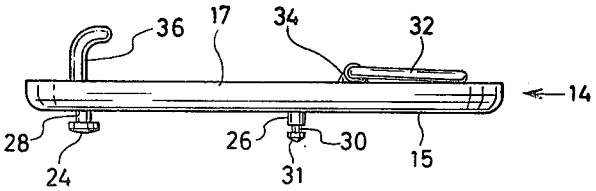
FIG. 3 is a top view of the base plate shown in FIG. 2.

Referring now to FIGS. 2 and 3, details of the base plate 14 are illustrated. As may be seen, the base plate 14 is essentially planar with the studs 24 and 26 projecting essentially vertically from a front face 15. The stud 24 has a shaft 28 of reduced diameter for purposes discussed hereinafter. Stud 26 has an annular recess of reduced diameter at 30, and having a width at least equal to the thickness of the blade 20, also whose purpose is described hereinafter. Preferrably the end 31 of the stud 26 is tapered as shown in FIG. 3. The rear surface 17 of the base plate 14, when used as a belt buckle or the like, is provided with appropriate apparel attachment means. This includes a loop 32 attached with hinged means 34 to the rear surface 17 of the base plate 14. Also, projecting from the rear surface 17 of the base plate 14 is a hook or prong 36 for engagement with apertures in a typical belt thereby permitting adjustments of the effective length of the belt in a manner similar to that known in the art.

Figure 4:
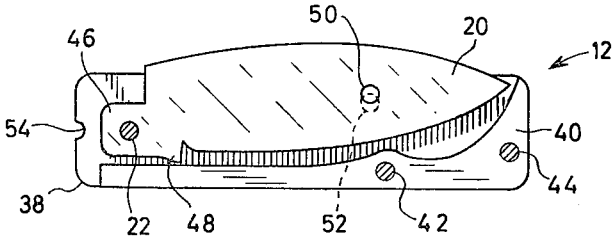
FIG. 4 is a longitudinal sectional drawing of the knife of FIG. 1.

The principle of operation of the present invention may be understood by referring to FIG. 4 when taken into combination with FIG. 1. This drawing is a sectional view of the knife 12 having the upper or front side plate 18 removed. Accordingly the rear side plate 38 may be seen. Also this permits the back spring 40 to be seen with its attachment rivets 42, 44. As illustrated above, the knife blade 20 is attached to the side plates 18 and 38 with a pivot 22. The area of the blade 20 surrounding this pivot comprises a conventional blade tang 46 and tang offset 48 that bears against the aforementioned back spring 40. The blade 20 is provided with aperture 50 having a diameter slightly in excess of the stud 26. Shown in phantom lines is an aperture 52 in the side plate 38 having a similar dimension to that of aperture 50. It may be seen that if the blade 20 is depressed toward the back spring 40, apertures 50 and 52 may be aligned to accept the aforementioned stud 26 therethrough. The apertures 50, 52 are only slightly misaligned when the blade is received between the side plates 18, 36. If the amount of displacement is less than one-half the diameter, the tapered end of the stud 26 can be pushed through both apertures to bring them into alignment. Thereafter, upon releasing pressure on the blade 20, the apertures 50, 52 tend to become displaced thereby causing the aperture 50 on the blade 20 to frictionally engage the recess 30 of the stud 26. The side plate 38 is provided with a notch 54 at an end near the blade pivot 22. Although less convenient, the notch 54 can be in the opposite end of the side plate 38. This notch 54 is provided to engage the aforementioned shaft 28 of stud 24. The spacing between the notch 54 and the apertures 50, 52, corresponds to the dimension between the stud 24 and the stud 26 shown in the figures. The lateral orientation of studs 24, 26 is chosen to artistically display the knife 12 on the base plate 14. Thus, they can be angularly oriented as shown, or they can be vertically or horizontally oriented.

From the foregoing description, the manner of attachment of the knife 12 to the back plate 14 may be ascertained. More specifically, this attachment includes placing the notch 54 of the side plate 38 against the shaft 28 of stud 24. Thereafter, the stud 26 may be received in aperture 52 of the side plate 38 and, upon depression of the blade 20 toward the back spring 40, the aperture 50 also accepts the stud 26. When the blade 20 is released, the aperture 50 engages the recess 30 of the stud 26 whereupon the knife 12 is securely attached to the base plate 14. Release of the knife 12 is accomplished in a reverse manner; that is, a slight depression of the blade 20 toward the back spring 40 permits the apertures 50 and 52 to be disengaged from stud 26. Thereafter notch 54 can be disengaged from the shaft 28 and the knife may be used in a normal manner.

A knife 12 having a single blade 20 is shown in the above-referenced drawings. The present invention however is not limited to a single bladed knife. A knife with additional blades hinged at the same end as blade 20, or at the opposite end of the knife, may similarly be attached to a base plate. The only limitation is that the blade closest to the base plate would be provided with the afore-mentioned aperture 50. Normally this will be the largest blade of the knife in order that the upper edge thereof is accessible for the application of a depressing force. (All blades could be provided with apertures to receive the stud 26; however, this would be inconvenient in engagement with or release from the stud.) Further, the knife may have other constructions similar to those of U.S. Pat. Nos. 4,161,818, 4,218,819 and U.S. patent application Ser. No. 346,725, filed Feb. 8, 1982.

As stated above, the construction illustrated in FIGS. 1–3 is intended for use on a belt buckle. It will be understood that appropriate construction may be added to the rear surface 17 of the base plate 14 to accomplish attachment to other articles of wearing apparel. This may include the strap attachment of a woman's purse, to the surface of the purse itself, to a pocket clip, tie clip, etc. In all of the embodiments, the structure on the face 15 of the base plate 14 for the reception of the knife 12 and the appropriate engagement means on the knife would be substantially identical.

Figure 5:
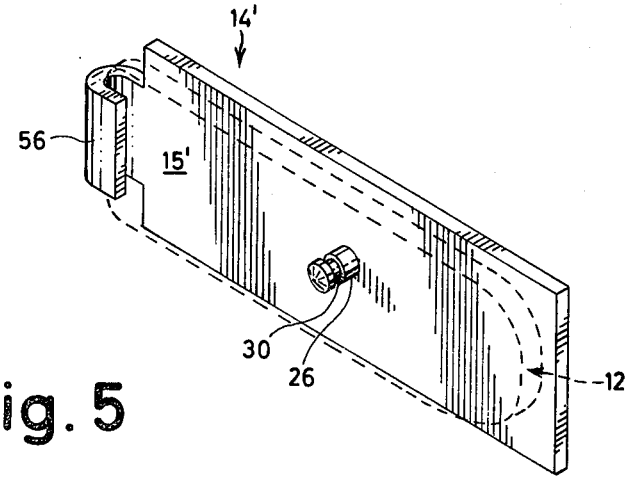
FIG. 5 is a drawing illustrating another embodiment of the present invention.

A horizontal orientation of a knife on a base plate, as referred to previously, is illustrated in FIG. 5. Also illustrated therein is another embodiment of means for releasible attachment of the folding knife to the base plate. In this embodiment, the base plate 14' is provided with a generally U-shaped clip 56. This clip 56 is sized to frictionally grasp the side plate of the knife 12 closest to the base plate 14'. The base plate 14' is provided with the same upright stud 26 as shown in the previous embodiment, and this stud (with annular recess 30) engages the blade of the knife in the same manner as previously described. It will be understood that the base plate 14' can be provided for attachment to wearing apparel, if desired.

From the foregoing it will be recognized that a convenient folding knife construction is provided which will make the knife readily accessible when its use is desired. If applied to a belt buckle, a person would normally be changing belts between different pairs of trousers and thus the knife would be automatically changed to the new pair of trousers. In a similar fashion, the knife attached to the strap of a woman's purse would be readily accessible and more convenient for use.

The feature of attachment to wearing apparel, although a particular advantage of the embodiments described above, is not a limitation to the present invention. Accordingly, the combination of a base and a releasible folding knife is the essential thrust of the present invention.

It is, of course, understood that although a preferred embodiment of the present invention has been illustrated and described, various modification thereof will become apparent to those skilled in the art. Accordingly, the scope of the invention should be defined only by the appended claims and the equivalence thereof.

I claim:

1. A folding knife unit having a releasible knife which comprises:

a folding knife having a first and further side plate, at least one back spring interposed between and attached to said side plates, and at least one knife blade in conventional biasing contact with said back spring interposed between said side plates and pivotally joined to said side plates at a first end thereof, said first side plate having first and further ends and provided with an aperture through said first side plate at a location substantially disposed from said first end, and wherein said blade is provided with an aperture proximately aligned with said aperture of said first side plate when said blade is disposed between said side plates; and a base having a substantially planar surface with first and further opposite ends, provided with attachment means projecting from said surface proximate said first end, contoured for releasible engagement with said first end of said first side plate and a first stud projecting from said surface positioned and contoured for engagement with said aperture in said first side plate and said aperture in said blade when said first end of said first side plate is engaged with said attachment means.

2. The folding knife unit of claim 1 wherein said attachment means projecting from said surface of said base is a U-shaped clip for frictional engagement with said first end of said first side plate.

3. The folding knife unit of claim 1 wherein said first end of said first side plate is provided with a notch, and said attachment means is a further stud projecting from said surface for engagement with said notch, said further stud spaced from said first stud a distance corresponding to the spacing of said aperture in said first side plate and said notch.

4. The folding knife unit of claim 1 wherein said aperture in said first side plate is displaced from said aperture in said blade less than one-half the diameter of said aperture in said blade, when said blade is received between said side plates, and said first stud is provided with a tapered end portion, whereby when said further stud is passed through said aperture in said first side plate, said tapered end portion moves said blade against biasing action of said back spring and aligns said aperture of said blade with said aperture of said first side plate.

5. The folding knife unit of claim 1 wherein said first stud is provided with an annular recess therein, the spacing of said recess from said surface of said base being at least equal to the distance from the exterior of said first side plate to said knife blade, the width of said recess being at least the thickness of said blade whereby said biasing contact of said backspring on said blade provides for interlocking said aperture of said blade with said recess.

6. A folding knife unit for attachment to wearing apparel and the like, which comprises:

a folding knife having a first and further side plate, at least one back spring interposed between and attached to said side plates and at least one knife blade in contact with said back spring interposed between said side plates and pivotally joined to said side plates at a first end thereof, said first side plate being provided with a notch at one end and an aperture through said first side plate at a location substantially disposed from said notch, and wherein said blade is provided with an aperture proximately aligned with said aperture of said first side plate when said blade is disposed between said side plates; and a base plate having a substantially planar surface, said base plate provided with means for attachment to such apparel or the like, and further provided with a first stud projecting from said surface, contoured for releasible engagement with said notch of said first side plate and a further stud projecting from said surface positioned and contoured for engagement with said aperture in said first side plate and said aperture in said blade when said notch is engaged with said first stud.

7. The folding knife unit of claim 6 wherein said means for attachment to such apparel or the like on said base plate is a loop to receive an end of a body-encircling belt, said belt provided with apertures, together with a hook to engage one of said apertures to adjust the effective length of said belt.

8. The folding knife unit of claim 7 wherein said loop and hook are fastened to a rear surface of said base plate.

9. The folding knife unit of claim 6 wherein said first stud is provided with a shaft to be received in said notch and a head attached to said shaft having a size greater than said notch.

10. The folding knife unit of claim 6 wherein said further stud is provided with a shaft containing an annular recess therein, the spacing of said recess from said surface of said base plate being at least equal to the distance from the exterior of said first side plate to said knife blade, the width of said recess being at least the thickness of said blade whereby action of said backspring on said blade provides for interlocking said aperture of said blade with said recess.

11. The folding knife unit of claim 6 wherein said blade pivot is adjacent said notch in said first side plate.

12. The folding knife unit of claim 6 wherein said aperture in said first side plate is displaced from said aperture in said blade less than one-half the diameter of said aperture in said blade, when said blade is received between said side plates, and said further stud is provided with a tapered end portion, whereby when said further stud is passed through said aperture in said first side plate, said tapered end portion moves said blade against biasing action of said back spring and aligns said aperture of said blade with said aperture of said first side plate.

* * * * *